US011019446B2

(12) United States Patent
Kotulla

(10) Patent No.: US 11,019,446 B2
(45) Date of Patent: May 25, 2021

(54) METHOD FOR GENERATING AND OUTPUTTING AN ACOUSTIC MULTICHANNEL SIGNAL

(71) Applicant: ASK INDUSTRIES GMBH, Niederwinkling (DE)

(72) Inventor: Daniel Kotulla, Mitterfels (DE)

(73) Assignee: ASK INDUSTRIES GMBH, Niederwinkling (DE)

( * ) Notice: Subject to any disclaimer, the term of this patent is extended or adjusted under 35 U.S.C. 154(b) by 0 days.

(21) Appl. No.: 16/495,074

(22) PCT Filed: Mar. 16, 2018

(86) PCT No.: PCT/EP2018/056692
§ 371 (c)(1),
(2) Date: Sep. 17, 2019

(87) PCT Pub. No.: WO2018/172213
PCT Pub. Date: Sep. 27, 2018

(65) Prior Publication Data

US 2020/0092669 A1 Mar. 19, 2020

(30) Foreign Application Priority Data

Mar. 21, 2017 (DE) ..... 102017106048.0

(51) Int. Cl.
*H04S 7/00* (2006.01)
*H04R 5/02* (2006.01)
(Continued)

(52) U.S. Cl.
CPC ..... *H04S 7/30* (2013.01); *H04R 5/02* (2013.01); *H04R 5/04* (2013.01); *H04S 3/008* (2013.01);
(Continued)

(58) Field of Classification Search
CPC ..... G10L 19/008; H04S 2400/01; H04S 2400/05; H04S 2420/01; H04S 3/008;
(Continued)

(56) References Cited

U.S. PATENT DOCUMENTS

2003/0039365 A1* 2/2003 Eid ..... H04S 3/02 381/27
2008/0273722 A1* 11/2008 Aylward ..... H04R 5/02 381/302
(Continued)

FOREIGN PATENT DOCUMENTS

DE 102012025016 B3 5/2014
DE 102012224454 A1 7/2014
(Continued)

*Primary Examiner* — Norman Yu
(74) *Attorney, Agent, or Firm* — Rimôn, P.C.

(57) ABSTRACT

Method for generating and outputting an acoustic multichannel signal, comprising the steps of:

Figure 1:
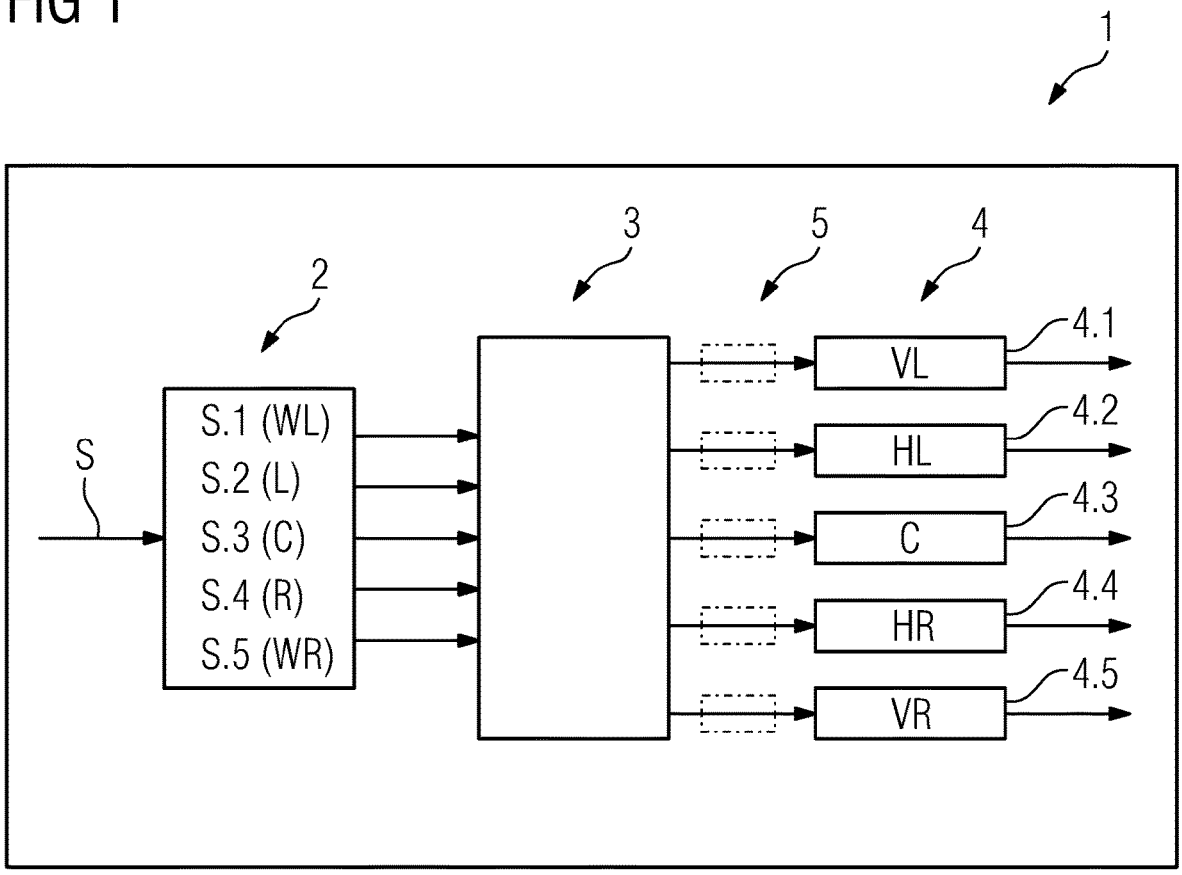

supplying a stereo signal (S), splitting the supplied stereo signal (S) into a plurality of perception-direction-dependent acoustic signal components (S.1-S.5), generating an acoustic multichannel signal by mixing each perception-direction-dependent acoustic signal component (S.1-S.5) onto an output channel (4.1-4.12) of an acoustic output apparatus (4) that comprises a plurality of, in particular more than two, acoustic output channels (4.1-4.12), outputting the generated multichannel signal over respective acoustic output channels (4.1-4.12) of the acoustic output apparatus (4).

6 Claims, 2 Drawing Sheets

(51) Int. Cl.
*H04R 5/04* (2006.01)
*H04S 3/00* (2006.01)

(52) U.S. Cl.
CPC ..... *H04R 2499/13* (2013.01); *H04S 2400/01* (2013.01); *H04S 2400/05* (2013.01)

(58) Field of Classification Search
CPC ... H04S 5/00; H04S 7/30; H04S 7/302; H04S 2420/11; H04S 7/303; H04S 1/002; H04S 2420/13; H04S 5/005; H04S 3/00; H04S 5/02; H04R 5/02; H04R 5/04; H04R 2201/401; H04R 5/00; H04R 2499/13; H04R 2205/024; H04R 3/12; H04R 2203/12; H04R 2430/20; H04R 2430/23; H04R 29/002; H04R 2201/40; H04M 3/568
USPC .. 381/303, 17, 18, 86, 300, 307, 1, 103, 27, 381/302, 306, 59, 80, 94.3
See application file for complete search history.

(56) References Cited

U.S. PATENT DOCUMENTS

2008/0298597 A1 12/2008 Turku
2015/0326988 A1* 11/2015 Zielinsky ..... G06F 3/165 381/307

FOREIGN PATENT DOCUMENTS

WO 2008023178 A1 2/2008
WO WO-2016156237 A1 * 10/2016 ..... H04S 5/005

* cited by examiner

METHOD FOR GENERATING AND OUTPUTTING AN ACOUSTIC MULTICHANNEL SIGNAL

CROSS-REFERENCE TO RELATED APPLICATIONS

This application claims priority to Patent Cooperation Treaty application serial number PCT/EP2018/056692, filed Mar. 16, 2018, which claims priority to German patent application serial number DE 10 2017 106 048.0, filed Mar. 21, 2017, the contents of each of which are incorporated herein by reference in their entirety.

The invention relates to a method for generating and outputting an acoustic multichannel signal.

It is known to incorporate acoustic signals from a plurality of sound sources in order to generate a stereo signal, which is intended to produce a three-dimensional acoustic effect for a listener in a natural listening situation. In a known manner, level differences or propagation-time differences, for example, can be utilized to generate stereo signals.

In order for it to be possible to further enhance corresponding stereo signals by generating a multichannel signal with a view to a three-dimensional listening sensation, it is known to mix said stereo signals onto surround-sound signals, i.e. 5.1 surround-sound signals, for example, and to output said stereo signals over acoustic output channels of an acoustic output apparatus that are specially distributed around a room. Known principles use simple matrix multiplications of the left and right signal components of a stereo signal when generating corresponding surround-sound signals. Typically, a three-dimensional listening sensation is generated by adding various Hall effects here.

By contrast, the invention addresses the problem of providing a new and improved principle for generating and outputting a multichannel signal starting from a stereo signal which in particular provides the option of generating a three-dimensional listening sensation ("3D surround sound") without needing to add Hall effects.

The problem is solved by a method according to claim 1. The claims that are dependent thereon relate to possible embodiments of the method.

The method described herein serves to generate and output an acoustic multichannel signal, which is typically a surround-sound signal, starting from a stereo signal. The aim of the method is in particular to generate a multichannel signal that is to be output by an acoustic output apparatus that comprises a plurality of, i.e. more than two, output channels (speakers), which multichannel signal makes it possible to give a listener a three-dimensional listening sensation ("3D effect", "3D surround sound").

In a first step of the method, a stereo signal is supplied. The stereo signal can be supplied in various ways. For example, the stereo signal can be supplied via a sound storage medium, i.e. a CD, for example, a data storage medium, i.e. hard-disk storage, for example, or a data network, i.e. the Internet, for example. For example, the stereo signal may be a piece of music, a piece of text, etc.

In a second step of the method, the supplied stereo signal is split into a plurality of perception-direction-dependent signal components ("signal components"). To do this, the stereo signal is analyzed for individual signal components by means of suitable analysis apparatuses, which components, when the stereo signal is actually output by an output apparatus that comprises two output channels, i.e. a left and a right output channel, correspond or would correspond to an output direction or position perceived by a listener positioned in a defined position relative to the output apparatus outputting the stereo signal in question. A corresponding defined position of a listener relative to an output apparatus outputting the stereo signal may, for example, be the apex of the stereo triangle, in which the listener forms an equilateral triangle with the output channels or speakers.

A corresponding signal component may e.g. be a center signal component, which would correspond to an output direction or position that is centrally perceived by a listener when the stereo signal is actually output by an output apparatus that comprises two output channels. A corresponding signal component may e.g. also be a left signal component or a right signal component, which would correspond to an output direction or position that is perceived (more) to the left or (more) to the right (in relation to a center) by a listener when the stereo signal is actually output by an output apparatus that comprises two output channels.

The splitting of the stereo signal carried out by means of suitable splitting apparatuses or algorithms can provide a large number of perception-direction-dependent signal components; therefore, a stereo signal can in principle be split into all the perception-direction-dependent signal components of the stereo signal in question. The number of perception-direction-dependent signal components that are actually obtained may be selected with regard to the number of output channels of the output apparatus over which the multichannel signal that has been generated or is being generated according to the method is to be output. The number of perception-direction-dependent signal components that are actually obtained can therefore be predeterminable or predetermined.

In a third step of the method, an acoustic multichannel signal or surround-sound signal is generated by mixing each of the perception-direction-dependent signal components obtained after the stereo signal is split into corresponding perception-direction-dependent signal components as described onto a specific output channel of an output apparatus that comprises a plurality of, i.e. more than two, output channels. Each perception-direction-dependent signal component obtained from the stereo signal being split into corresponding perception-direction-dependent signal components is therefore mixed onto a specific output channel of an output apparatus that comprises a plurality of output channels, i.e. a 5.1 surround-sound output apparatus, for example. The output apparatus may be installed in a motor vehicle.

As part of mixing the perception-direction-dependent signal components, the perception-direction-dependent signal components can be assigned to specific output channels of the output apparatus in line with a specific assignment specification. When assigning the perception-direction-dependent signal components to specific output channels of the output apparatus, the assignment specification can take into account the output direction or position of the relevant perception-direction-dependent signal component that is perceived by a listener of the stereo signal and corresponds to a relevant perception-direction-dependent signal component. For example, a center signal component can be assigned to a center output channel of the output apparatus and can be output over said channel. The same applies to all the other signal components; therefore, a left signal component can be assigned to a left output channel of the output apparatus and output over said channel and a right signal component can be assigned to a right output channel of the output apparatus and output over said channel.

In a fourth step of the method, the multichannel signal or the perception-direction-dependent signal components are lastly output over respective output channels of the output apparatus. This makes it possible to give the listener a three-dimensional listening sensation ("3D surround sound") without it being absolutely necessary to add Hall effects.

In one embodiment of the method, the supplied stereo signal can be split into a plurality of direction-dependent signal components by means of a source-separation apparatus. A corresponding source-separation apparatus can be implemented by a source-separation algorithm, for example. A suitable method for source separation or a suitable source-separation algorithm is described in German patent DE 10 2012 025 016 B3, for example, with reference being explicitly made to the disclosure thereof.

In another embodiment of the method, it is possible for the perception-direction-dependent signal components to be mixed onto respective output channels of the acoustic output apparatus with specific amplification factors or coefficients or attenuation factors or coefficients. By selecting appropriate amplification or attenuation factors, it can be ascertained which signal component is mixed onto a relevant output channel in what ratio, for example. By amplifying or attenuating individual, multiple or all signal components, which is achieved by accordingly factoring individual, multiple or all signal components (this can generally also be understood to be a weighting of perception-direction-dependent signal components), the three-dimensional listening sensation can be influenced in a targeted manner, i.e. in particular amplified.

In another embodiment of the method, it is possible for individual, multiple or all perception-direction-dependent signal components to be mixed with a specific Hall effect or convolution reverb. In this way, too, the three-dimensional listening sensation can be influenced in a targeted manner, i.e. in particular amplified. Depending on the properties of the relevant Hall effect, i.e. in particular of the transfer function of the Hall coefficients, a much larger listening space than is actually present can be simulated. As explained above, a three-dimensional listening sensation is not actually generated by adding Hall effects; the method described herein makes it possible to give the listener a three-dimensional listening sensation ("3D effect") without it being absolutely necessary to add Hall effects.

As part of the method, the stereo signal can for example be split into at least one center signal component, one left signal component perceived to the left of the center signal component and one right signal component perceived to the right of the center signal component. This applies in particular to the output of the perceived multichannel signal by an output apparatus that comprises a left output channel, a right output channel and a center output channel.

It is also conceivable for the supplied acoustic stereo signal to be split into at least one center signal component, an internal left signal component perceived to the left of the center signal component, an external left signal component perceived to the left of the internal left signal component, an internal right signal component perceived to the right of the center signal component and an external signal component perceived to the right of the internal right signal component. This applies in particular to the output of the multichannel signal to be output by an output apparatus, i.e. a surround-sound output apparatus, for example, comprising a center output channel, a rear left output channel, a front left output channel, a rear right output channel and a front right output channel.

In addition to the method, the present invention relates to a device for generating and outputting an acoustic multichannel signal, in particular according to the described method. The device comprises a hardware-implemented and/or software-implemented splitting apparatus configured to split a supplied acoustic stereo signal into a plurality of perception-direction-dependent acoustic signal components, a hardware-implemented and/or software-implemented mixing apparatus configured to mix a perception-direction-dependent acoustic signal component onto an output channel of an output apparatus that comprises a plurality of, in particular more than two, acoustic output channels and to generate an acoustic multichannel signal by mixing each perception-direction-dependent signal component onto an output channel of an acoustic output apparatus that comprises a plurality of, in particular more than two, acoustic output channels, and an acoustic output apparatus that comprises a plurality of, in particular more than two, acoustic output channels, which apparatus is configured to output the multichannel signal over respective acoustic output channels. The device may be installed in a motor vehicle. All the embodiments relating to the method apply by analogy to the device.

Figure 2:
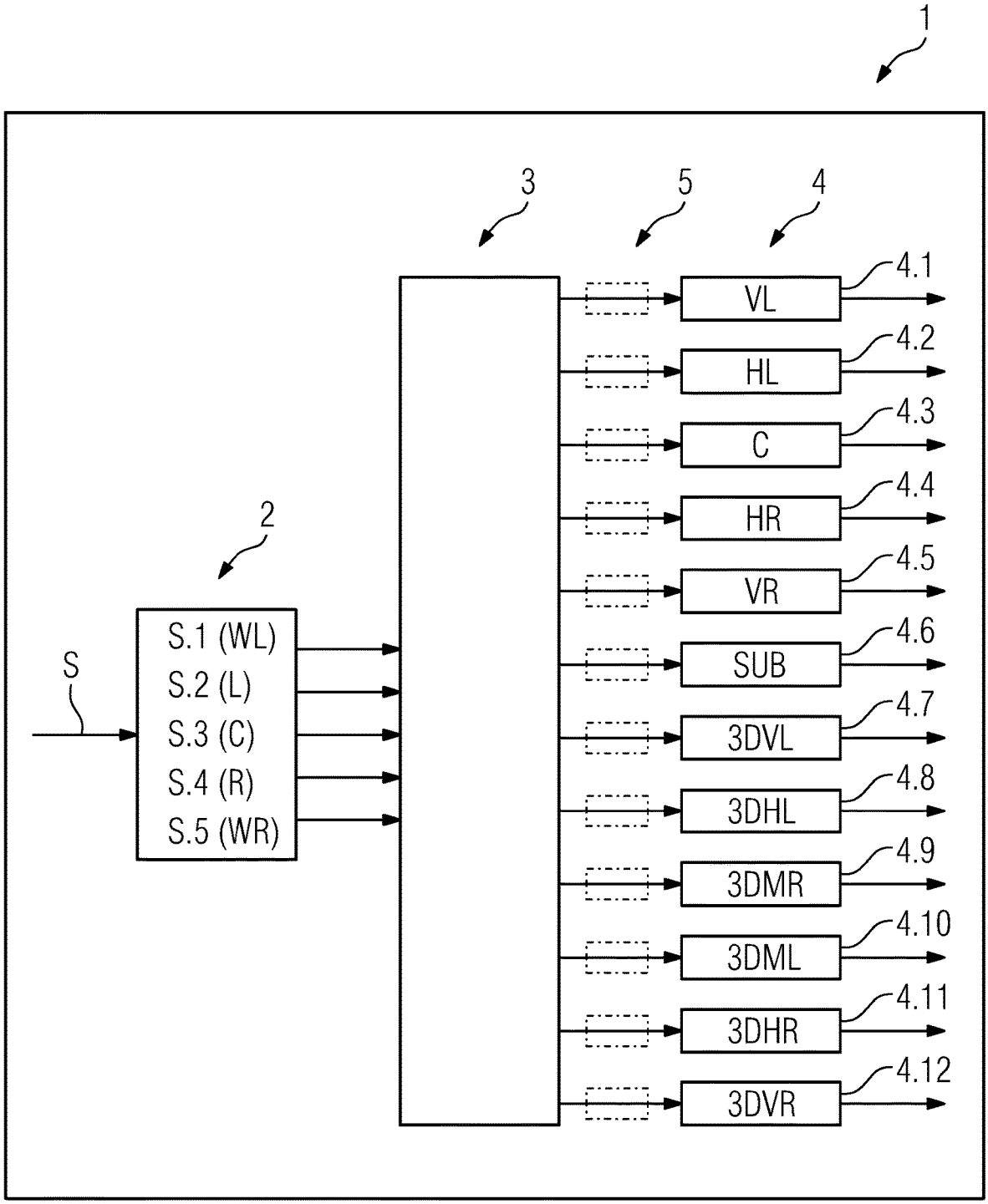

The invention is explained in greater detail on the basis of embodiments in the figures of the drawings, in which:

FIGS. 1 and 2 each show a schematic diagram of a device according to an embodiment.

FIG. 1 shows a schematic diagram of a device 1 according to an embodiment. The device 1, which is installed in a motor vehicle (not shown), for example, is configured to generate and output an acoustic multichannel signal.

As functional components, the device 1 comprises a hardware-implemented and/or software-implemented splitting apparatus 2, a hardware-implemented and/or software-implemented mixing apparatus 3 and an acoustic output apparatus 4 that comprises a plurality of, in particular more than two, acoustic output channels 4.1-4.12 (speakers).

The splitting apparatus 2 is configured to split a supplied acoustic stereo signal S, i.e. a piece of music, for example, into a plurality of perception-direction-dependent acoustic signal components S.1-S.5. The splitting apparatus 3 is configured to mix a perception-direction-dependent acoustic signal component S.1-S.5 onto an output channel 4.1-4.12 of the output apparatus 4 and to generate an acoustic multichannel signal by mixing each perception-direction-dependent signal component S.1-S.5 onto an output channel 4.1-4.12 of the output apparatus 4. The functional interaction between the above-mentioned functional components of the device 1 is described in greater detail in conjunction with the following explanation of the method that can be implemented by the device 1 for carrying out a method for generating and outputting an acoustic multichannel signal.

The device 1 is therefore configured to carry out a method for generating and outputting an acoustic multichannel signal; in this case, this is typically a surround-sound signal. The aim of the method is in particular to generate a multichannel signal that is to be output by an acoustic output apparatus 4 that comprises a plurality of, i.e. more than two, output channels 4.1-4.12, which multichannel signal makes it possible to give a listener a three-dimensional listening sensation ("3D effect" or "3D surround sound"). The output apparatus 4 may be installed in a motor vehicle (not shown).

In a first step of the method, a stereo signal S is supplied. The stereo signal S can be supplied in various ways. For example, the stereo signal S can be supplied via a sound storage medium, i.e. a CD, for example, a data storage medium, i.e. hard-disk storage, for example, or a data network, i.e. the Internet, for example.

In a second step of the method, the supplied stereo signal S is split into a plurality of perception-direction-dependent signal components S.1-S.5 by means of the splitting apparatus 2. To do this, the stereo signal is analyzed for individual signal components S.1-S.5 using suitable analysis algorithms that are or can be assigned by means of the splitting apparatus 2, which components, when the stereo signal S is actually output by an output apparatus that comprises two output channels, i.e. a left and a right output channel, correspond or would correspond to an output direction or position perceived by a listener.

The stereo signal S can be split into a plurality of direction-dependent signal components by means of a hardware-implemented and/or software-implemented source-separation apparatus (not shown) associated with the splitting apparatus 2. A corresponding source-separation apparatus can be implemented by a source-separation algorithm, for example.

In the embodiments shown in the drawings, the stereo signal S is, for example, split into five signal components S.1-S.5, namely a center signal component S.3, an internal left signal component S.2 perceived to the left of the center signal component S.3, an external left signal component S.1 perceived to the left of the internal left signal component S.2, an internal right signal component S.4 perceived to the right of the center signal component S.3 and an external signal component S.5 perceived to the right of the internal right signal component S.4. This applies in particular, as set out in the following, to the output of the perceived multichannel signal by an output apparatus 4 that comprises five output channels 4.1-4.5, i.e. a center output channel 4.3, a rear left output channel 4.2, a front left output channel 4.1, a rear right output channel 4.4 and a front right output channel 4.5, for example. A corresponding output apparatus is shown in FIG. 1. In the embodiment shown in FIG. 1, the essentially predeterminable or predetermined number of perception-direction-dependent signal components S.1-S.5 that are actually obtained is selected with regard to the number of output channels 4.1-4.5 of the output apparatus 4.

In a third step of the method, an acoustic multichannel signal is generated by mixing the perception-direction-dependent signal components S.1-S.5 onto a specific output channel 4.1-4.5 of the output apparatus 4. Each perception-direction-dependent signal component S.1-S.5 obtained from the stereo signal S being split into corresponding perception-direction-dependent signal components S.1-S.5 is therefore mixed onto a specific output channel S.1-S.5 of the output apparatus 4, i.e. a 5.1 surround-sound output apparatus, for example.

As part of mixing the perception-direction-dependent signal components S.1-S.5, the perception-direction-dependent signal components S.1-S.5 can be assigned to specific output channels 4.1-4.5 of the output apparatus 4 in line with a specific assignment specification. When assigning the perception-direction-dependent signal components S.1-S.5 to specific output channels 4.1-4.5 of the output apparatus 4, the assignment specification can take into account the output direction or position of the relevant perception-direction-dependent signal component S.1-S.5 that is perceived by a listener of the stereo signal S and corresponds to a relevant perception-direction-dependent signal component S.1-S.5. For example, a center signal component S.3 can be assigned to a center output channel 4.3 of the output apparatus 4 and can be output over said channel.

The perception-direction-dependent signal components S.1-S.5 are mixed onto respective output channels 4.1-4.5 of the acoustic output apparatus 4 with specific amplification factors or coefficients or attenuation factors or coefficients. By selecting appropriate amplification or attenuation factors, it can be ascertained which perception-direction-dependent signal component S.1-S.5 is mixed onto a relevant output channel 4.1-4.5 in what ratio, for example.

By way of the Hall-effect apparatuses 5, which are shown by dashed lines as they are optional (here, these may be FIR filter apparatuses, for example), FIG. 1 shows that individual, multiple or all perception-direction-dependent signal components S.1-S.5 can be mixed with a specific Hall effect or convolution reverb.

In a fourth step of the method, the multichannel signal or the perception-direction-dependent signal components S.1-S.5 are lastly output over respective output channels 4.1-4.5 of the output apparatus 4. This makes it possible to give the listener a three-dimensional listening sensation ("3D surround sound") without it being absolutely necessary to add Hall effects.

FIG. 2 shows a schematic diagram of a device 1 according to another embodiment. It is clear from the embodiment shown in FIG. 2 that the number of perception-direction-dependent signal components S.1-S.5 does not necessarily have to correspond to the number of output channels 4.1-4.12 of the output apparatus 4.

The output apparatus 4 shown in the embodiment shown in FIG. 2 namely comprises, in addition to the typical output channels 4.1-4.6 of a 5.1 surround-sound output apparatus, a center output channel 4.3, a rear left output channel 4.2, a front left output channel 4.1, a rear right output channel 4.4, a front right output channel 4.5 and a subwoofer output channel 4.6, additional output channels 4.7-4.12 (3D speakers), which are in particular arranged on the ceiling and enhance the three-dimensional listening sensation, namely an additional front left output channel 4.7, an additional front right output channel 4.8, an additional left center output channel 4.9, an additional right center output channel 4.10, an additional rear left output channel 4.11 and an additional rear right output channel 4.12.

The invention claimed is:

1. Method for generating an acoustic multichannel audio signal and outputting same in a vehicle via a multichannel output apparatus comprising at least one left output channel, at least one right output channel, and at least one center output channel, the method comprising the steps of:

supplying a stereo audio signal, splitting the supplied stereo audio signal into a plurality of perception-direction-dependent acoustic signal components each comprising individual directionally-dependent perceived audio signal information of the stereo audio signal by means of a source separation apparatus, wherein the supplied stereo audio signal is split into at least one center signal component comprising directionally-dependent perceived audio signal information of the stereo audio signal which would be perceived as center audio information, at least one left signal component comprising directionally-dependent perceived audio signal information of the stereo audio signal perceived to the left of the at least one center signal component, and at least one right signal component comprising directionally-dependent perceived audio signal information of the stereo audio signal perceived to the right of the at least one center signal component; wherein the plurality of perception-direction-dependent acoustic signal components being created independent of the multichannel output apparatus; wherein before splitting, the stereo audio signal is analyzed for individual signal components comprising individual directionally-dependent perceived audio signal information of the stereo audio signal by one or more analyzing devices based on an output direction or position that would be perceived by a listener positioned in a defined position relative to an acoustic output apparatus that only comprises a left and a right output channel;

assigning the perception-direction-dependent signal components to at least one left output channel, at least one right output channel, and at least one center output channel specific output channels of a multichannel output apparatus based on an assignment specification accounting for the output direction or position of at least one of the plurality of perception-direction-dependent acoustic signal components that is perceived by a listener of the stereo audio signal and corresponds to a relevant perception-direction-dependent signal component;

generating an acoustic multichannel audio signal by mixing each perception-direction-dependent acoustic signal component onto the at least one left output channel, the at least one right output channel, or the at least one center output channel of the multichannel output apparatus, and outputting the generated acoustic multichannel audio signal over the at least one left output channel, the at least one right output channel, and the at least one center output channel of the multichannel output apparatus.

2. Method according to claim 1, wherein the number of perception-direction-dependent signal components is selected with regard to the number of output channels of the multichannel output apparatus over which the generated acoustic multichannel audio signal is output.

3. Method according to claim 1, wherein the perception-direction-dependent signal components are mixed onto respective output channels of the multichannel output apparatus with specific amplification or attenuation factors.

4. Method according to claim 1, wherein at least one perception-direction-dependent signal component is mixed with a specific reverb effect.

5. Method according to claim 1, wherein the supplied stereo audio signal is split into at least one center signal component, an inner left signal component perceived to the left of the center signal component, an outer left signal component perceived to the left of the inner left signal component, an inner right signal component perceived to the right of the center signal component and an outer right signal component perceived to the right of the inner right signal component.

6. Device for generating an acoustic multichannel audio signal and outputting same in a vehicle via a multichannel output apparatus comprising at least one left output channel, at least one right output channel, and at least one center output channel, comprising:

a source separation apparatus configured to split a supplied stereo audio signal into a plurality of perception-direction-dependent acoustic signal components each comprising individual directionally-dependent perceived audio signal information of the stereo audio signal, wherein the perception-direction-dependent acoustic signal components comprise at least one center signal component comprising audio signal information of the stereo audio signal which would be perceived as center audio information, at least one left signal component comprising audio signal information of the stereo audio signal perceived to the left of the center signal component, and at least one right signal component comprising audio signal information of the stereo audio signal perceived to the right of the center signal component; the plurality of perception-direction-dependent acoustic signal components being created independent of the multichannel output apparatus;

wherein the source separation apparatus is configured to analyze the supplied stereo audio signal for individual signal components comprising individual directionally-dependent perceived audio signal information of the stereo audio signal by one or more analyzing devices before the splitting of the stereo audio signal based on an output direction or position that would be perceived by a listener positioned in a defined position relative to an acoustic output apparatus that comprises only a left and a right output channel;

a mixing apparatus configured to generate a multichannel audio signal by mixing each of the plurality of perception-direction-dependent acoustic signal components onto at least one left output channel, at least one right output channel, and at least one center output channel of a multichannel output apparatus, wherein the mixing apparatus is configured to assign the perception-direction-dependent acoustic signal components to specific output channels of the multichannel output apparatus comprising the at least one left output channel, the at least one right output channel, and the at least one center output channel based on an assignment specification accounting for the output direction or position of at least one of the plurality of perception-direction-dependent signal component that is perceived by a listener of the stereo audio signal and corresponds to a relevant perception-direction-dependent acoustic signal component; wherein the multichannel output apparatus is configured to output the multichannel audio signal over the at least one left output channel, the at least one right output channel, and the at least one center output channel.

* * * * *